United States Patent [19]

Savoie, Jr.

[11] 4,385,874

[45] May 31, 1983

[54] ROTARY PUMP APPARATUS WITH PLURAL ABUTTING PUMPING SEGMENTS

[76] Inventor: Hilbert J. Savoie, Jr., P.O. Box 98, Boutte, La. 70039

[21] Appl. No.: 145,672

[22] Filed: May 1, 1980

[51] Int. Cl.[3] ..... F04C 2/00; F04C 5/00

[52] U.S. Cl. ..... 418/56; 418/61 R; 418/153; 418/225

[58] Field of Search ..... 418/4, 56, 58, 61 R, 418/103, 157, 225, 227, 253, 153

[56] References Cited

U.S. PATENT DOCUMENTS

| | | | |
|---|---|---|---|
| 1,700,038 | 1/1929 | Feuerheerd | 418/225 |
| 1,866,761 | 7/1932 | Feuerheerd | 418/225 |
| 2,157,141 | 5/1939 | Murray | 418/157 |
| 3,447,476 | 6/1969 | Farris | 418/225 |
| 3,886,764 | 6/1975 | Edwards | 418/225 |

FOREIGN PATENT DOCUMENTS

| | | | |
|---|---|---|---|
| 997998 | 5/1976 | Canada | 418/270 |
| 1158638 | 7/1969 | United Kingdom | 418/61 R |

*Primary Examiner*—John J. Vrablik
*Attorney, Agent, or Firm*—Keaty & Keaty

[57] ABSTRACT

A rotary pump apparatus with plural abutting pumping segments has a wafer-like housing with an inner elliptical pumping chamber with intake and discharge ports for a fluid flow. A plurality of identical fluid moving cylindrical segments are movably disposed within the pumping chamber in such a manner that each of the segments abuts at least two other segments within the chamber.

The segments rotate in a circular rotary fashion urging the fluid flow between the intake and discharge ports.

The apparatus is also provided with a rotor plate rotatably mounted on the housing and a central driven shaft fixedly attached to one surface of the rotor plate. The rotor plate has a series of drive pegs disposed on the surface opposite to that where the shaft is attached. The drive pegs loosely extend through the openings in the cylindrical segments, and when the rotor shaft is rotated by an external power source, the rotational movement is transmitted via the rotor plate to the drive pegs and then to the cylindrical segments urging them to rotate in a concentric fashion around the pegs and in a circular rotary fashion within the chamber.

The entire assembly of drive pegs and cylindrical segments is sealably enclosed in the housing by a pair of cover plates sealably fitted to the housing to enclose the inner chamber, which in the preferred embodiment would be elliptical.

In this preferred embodiment the volume of area between the cylindrical segments and the inner wall of the chamber can fluctuate during the rotation as the segments move in their elliptical path. The pump is so constructed that when the space is increased, a vacuum is created above the inlet ports and liquid is drawn into the chamber, and simultaneously, when the space is restricted between the cylindrical segments, the fluid is forced out of the chamber via the outlet ports.

31 Claims, 18 Drawing Figures

ROTARY PUMP APPARATUS WITH PLURAL ABUTTING PUMPING SEGMENTS

BACKGROUND OF THE INVENTION

1. Field of the Invention

The present invention relates to pumps and more particularly relates to an all purpose rotary pump apparatus having a plurality of separate touching driven ring segments mounted within a chamber as the fluid mover.

2. Background of the Prior Art

Pumps are utilized in all phases of commerce and industry where there is a need to transport fluids, or fluid like material (such as liquids, slurries, gases and the like) from one point to another through pipelines or a piping system, or to generate pressures to operate equipment.

It is also desirable, in order to effect a rapid and efficient transport of fluids that the fluid be transported under pressure. This rapid transport under pressure is most often accomplished through the use of a pumping system whereby the fluid is moved through a transport pipeline at least in part as a result of pressure created by a pump or pumping system.

Usually such a pumping system requires maintenance because of the numerous moving parts, such as, for example, gears, pistons, valves, impellers, bearings, housings and the like.

When a breakdown occurs, the system, in most cases, must be disassembled, and, most often, this disassembly requires a great amount of money, time and labor. Another problem in the pump art relates to the wear that the pumping system undergoes, which results not only in faulting of the system, but, most importantly, the pressure buildup necessary to maintain the transport capability of the system is reduced, resulting in a reduction of the amount of fluid or gas pump transported, which of course could be translated in the loss of time, money, and energy consumption.

Still another problem is low efficiency due to the inefficient mechanical designs used. For example, in the common piston-driven pumping systems, the efficiency of the system is significantly reduced each time the piston is drawn back in order to be in position for forward driving and moving fluids out of the piston chamber.

Many pumps are only designs suitable for a single purpose or a single intended use. These prior art type pumps cannot handle a variety of pumping applications.

Also, many pump designs are not suitable for manufacture in any of a variety of given materials depending on intended uses or purpose.

Some prior art type pump designs are not useful in a variety of pressure operating levels between low pressures and high pressures depending upon the purpose or application.

It would be desirable that a pump be able to pump any of a given number of fluids, materials, such as water, oil, gas, hydraulic fluid, air, slurries, and the like. It would be desirable that in fact a pump be suited for use as a compressor of such fluids as gaseous matter such as air and the like.

It would also be desirable to provide a pump apparatus which could function as a vacuum pump.

Thus, it is an object of the present invention to provide an all purpose pump.

It is yet another object of the present invention to provide a marine water pump being manufactured in a variety of materials depending upon the intended use.

Still another object of the present invention would be to provide a general purpose pump with a choice of pump materials compatible with the design producing a broad spectrum of pump use.

Another object of the present invention to provide a high pressure pump which could function as a positive displacement pump.

Still another object of the present invention would be to provide a pump apparatus which could function as a gas or air compressor.

Another object of the present invention would be to provide a pump apparatus which could function as a vacuum pump.

Still another object of the present invention would be to provide a pump apparatus which could function as a pressure motor, fluid or gas operated.

Still another object of the present invention would be to provide a pump apparatus which could function as a fluid coupling or fluid clutch.

GENERAL DESCRIPTION OF THE PRESENT INVENTION

The present invention provides a rotary pump for pumping fluids or fluid like material (such as for example, water, oil, gas, hydraulic fluid, air, gas, slurries and the like) between points. The pump would provide a wafer like housing having an elliptical pumping chamber with intake and discharge parting fluid flow respectively to and from the pumping chamber. A central driven shaft connected to a rotor plate is rotatably mounted on the housing such that when the shaft is rotated by an external power source, the rotor plate rotates in a circular fashion. A plurality of separate fluid moving segments are movably disposed within the pumping chamber and rotate therewithin in a circular rotary fashion urging fluid flow (under high pressure and positive displacement if desired) between the intake and discharge.

The rotor place has a series of drive pegs on the surface opposite the connection of the shaft. In the preferred embodiment, each drive peg attaches to circulating segment, the inner diameter of each being greater than the diameter of the drive peg, resulting in the segments circulating around the drive peg in a concentric fashion. The entire assembly of drive pegs and ring segments would be sealably enclosed in the housing, with the pumping fluid in some cases acting as a lubricant (such as for example oil or hydraulic fluid) since moving parts, such as rotor, pegs, segments are immersed during operation in the pumping fluid within the pumping chamber. A pair of cover plates are sealably fitted to the housing to enclose the elliptical chamber and to define laterally the pathway for the segments and pegs as the rotor plate is rotated.

In order to function as a pumping system, parts extend to the pumping chamber of the housing and to both intake and discharge lines. When the system is in operation the intake line would feed the pumping system with fluid and the output line would retrieve fluids that are pumped out of that system. A third port (used to vent fluid from the center of the pumping chamber between the segments) extends from the central portion of the pumping chamber to the exterior of the system, that port leading to an output line which is fed back into the intake system.

As the rotor plate is rotated on the shaft, the circular rotation would engage each peg against the inner surface of the associated segments and result in their rotation therewith. The result is that the segments would rotate in an elliptical path, following the elliptical shaped wall of the chamber. It should be understood that the volume of area between the ring segments can fluctuate during the rotation of the rotor plate as the segments move from various points in their elliptical path. The pump is so constructed so that when the space is increased, a vacuum is created above the inlet ports and liquid is drawn into the chamber, and simultaneously, when the space is constricted between the ring segments, the fluid-material being pumped is forced out of the chamber via the outlet ports.

It is through this constant rotation of the segments in a rotary fashion about the pump axis that a continuous pumping action is maintained. It should be noted that the only moving parts of the system are the shaft-rotor plate-peg assembly and the segments.

Therefore, it is one object of this invention to provide a pump which utilizes a rotary system of pumping fluid or gases between points.

It is another object of the present invention to provide a simple pumping system, which is highly efficient, yet constructed of a few moving parts.

Another object of the present invention is to provide a rotary pump which is extremely sturdy, and can withstand tremendous wear and tear.

It is another object of the present invention provide a rotary pump system which can be produced comparatively inexpensively and can be produced in various sizes depending on intended use, but not limited to materials in the construction of the pump in whole or in part.

The pump of the present invention would be a versatile pump to meet a variety of pumping needs. The main feature is a rotor plate having attached driving pegs. The rotor plate is rotated by a driven shaft which provides an attachment thereon for attaching a conventional motor thereto for driving the shaft. The pegs force a plurality of corresponding roller rings or ring segments to move or rotate within an oblong, oval, elliptic or eccentric fashion within an eccentric housing.

Like all pumps, when used as a high pressure fluid or hydraulic pump, close tolerances are required. Therefore, a specially provided feature of the present invention is incorporated into the inner walls of the pump housing pumping chamber portion. This feature is an anti-jamming means which consists of two sections for example of soft material such as as neoprene rubber or the like placed in strategic locations.

When the inner segments are metallic or other rigid like material, the rollers or rings jam against the walls of the housing at the chamber inner wall. At this point, a cushion effect prevents jamming of the segments. The pliable or resilient material also serves as a seal which is beneficial to the performance of the pump. This anti-jamming or anti-locking function can be overcome with a spring loaded retracting metal or like material and can serve as well as the soft material such as neoprene which is the preferred construction.

An alternative design for the ring segments can be a soft resilient material such as rubber instead of the metallic rings shown in the drawings such as for example when the pump is a general purpose pump such as a water or fluid pump. Depending upon the purpose for which the pump will be used, the segments or rings may be constructed of metal, plastic, rubber, or the like. Also, a combination of the above materials could be used in the construction of the segments.

The segments can be circular or cylindrical in shape or can be an odd shape such as shown in the drawings in FIG. 11 having a tapered tail portion. Sleeve bushings or bearings can be added to the drive pegs to reduce friction and wear (see FIG. 4C).

BRIEF DESCRIPTION OF THE DRAWINGS

For a further understanding of the nature and objects of the present invention, reference should be had to the following detailed description, taken in conjunction with the accompanying drawings, in which like parts are given like reference numerals and wherein.

DETAILED DESCRIPTION OF THE PREFERRED EMBODIMENT

Figure 1:
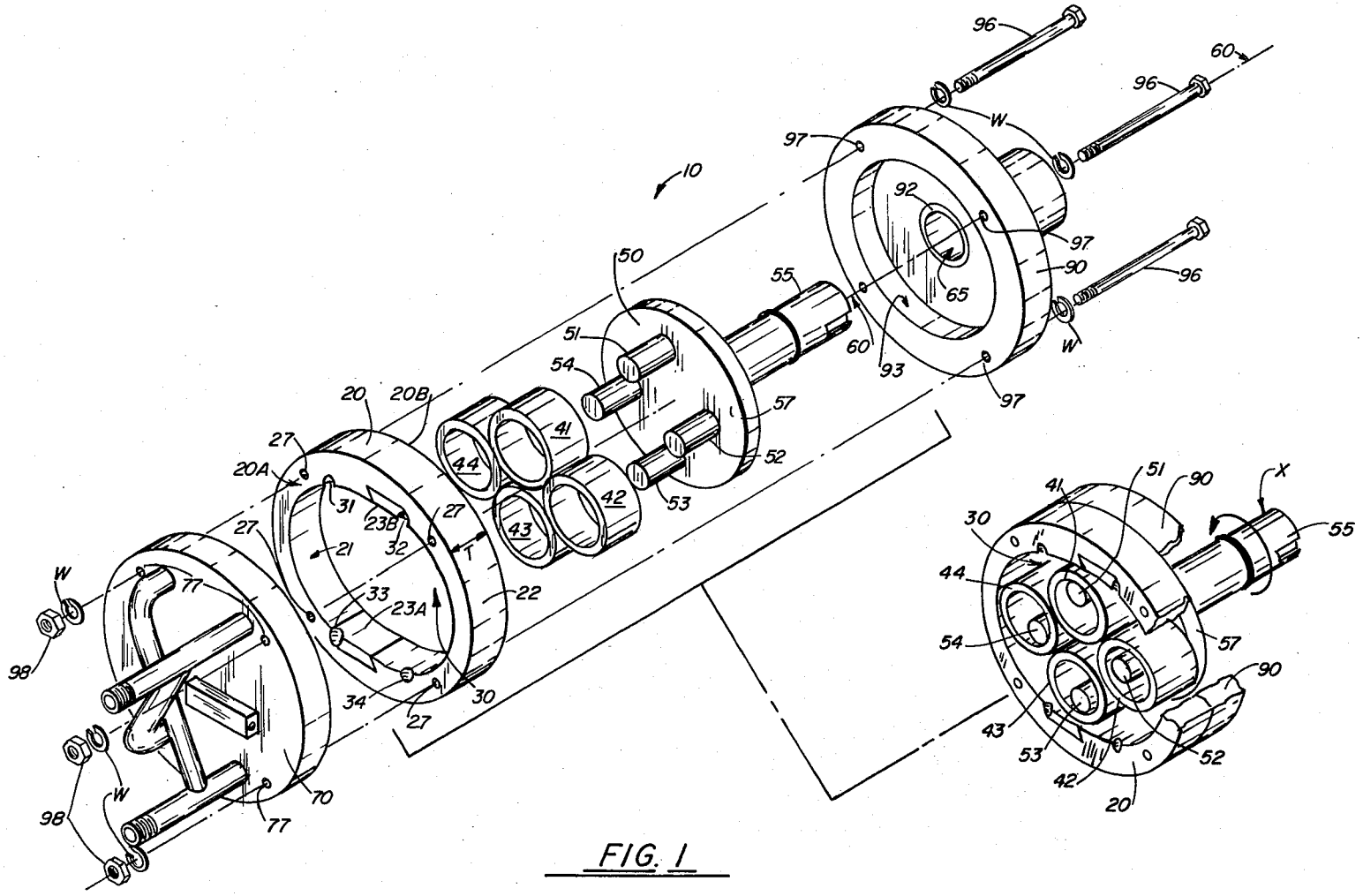
FIG. 1 is an exploded perspective view of the preferred embodiment of the apparatus of the present invention.
Figure 2A:
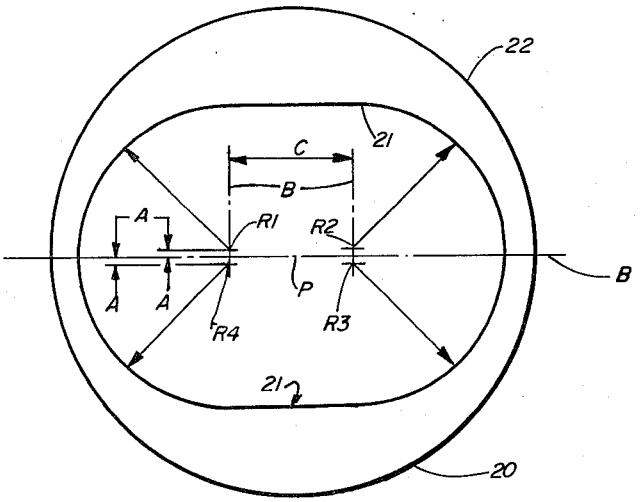
FIG. 2A is a sectional view of the preferred embodiment of the apparatus of the present invention showing the housing and pumping chamber portions thereof and a suitable chamber geometric construction.
Figure 2:
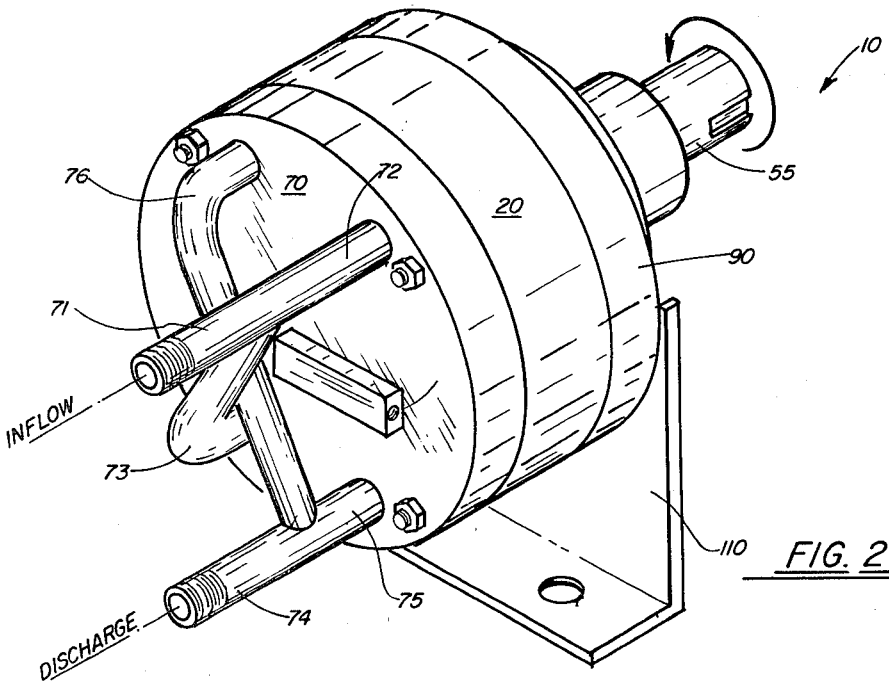
FIG. 2 is a perspective view of the preferred embodiment of the apparatus of the present invention.

FIGS. 1, 2 and 2A show best the preferred embodiment of the present invention designated generally by the numeral 10. A rotary pump apparatus 10 is comprised generally of housing 20 providing an inner pumping chamber 30. As will be described more fully hereinafter, chamber 30 is generally elliptical in shape (see FIG. 2A). A pair of cover plates 70,90 sealably attached to the side face 20A, 20B portions of housing 20 in a sealable fashion. A plurality of segments 41–44 are movably disposed within chamber 30. Note that in the preferred embodiment, each segment provides a thickness substantially equal to the thickness of chamber 30 as will be described more fully hereinafter. Segments 41–44 during operation are moved within an elliptical or rotational path about the axis 60 of pump 10. Segment drive 50 provides the rotational power necessary to move segments 41–44 in their rotational path which produces the necessary force to pump fluids. Segment drive assembly 50 comprises generally a drive shaft 55 which can receive a motor or like means for imparting rotational driving power to shaft 55, rotor plate 57, and drive pegs 51–54.

In the drawings, FIGS. 1 and 4A–4C illustrate best the construction of segment drive 50. Drive 50 provides circular rotor plate 57 having pegs 51 through 54. Pegs 51 through 54 are secured to the inner surface of rotor plate 57 so that each peg 51 through 54 is located equidistant from one another.

Figure 3A:
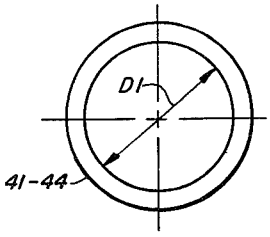
FIGS. 3A and 3B are side and top view respectively of a ring segment member portion of the preferred embodiment of the present invention.
Figure 3B:
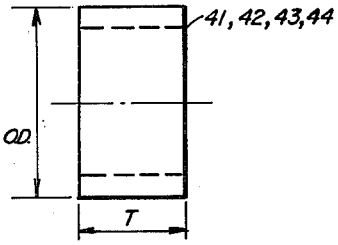

FIGS. 3A–3B best show segments 41 through 44. Each of segments 41 through 44 are fitted during assembly of pump apparatus 10 to pegs 51 through 54. The inner diameter D1 of the segments 41 through 44, (See FIG. 3A) is an increase in diameter over the diameter D2 (FIG. 4B) of the pegs 51 through 54, with segments 41 through 44 freely circulating concentrically in a path designated by the inner walls of segments 41 through 44 as they are in contact with the exterior wall of pegs 51 through 54.

FIGS. 1 and 2A illustrate more particularly housing 20 which has circular exterior wall 22 and elliptical inner wall 21. Housing 20 provides inner pumping chamber 30 defined by inner wall 21. The shape of the inner chamber 30 is generally elliptical in the preferred embodiment. Reference is made to FIGS. 3B and 4B which illustrate a side view of segments 41 through 44 and rotor plate pegs 51–54. Segments 41 through 44, pegs 51 through 54 and housing 20 are preferably of equal thickness "T". Cover plate 70 is then sealably secured to surface 20A of housing 20 as is cover plate 90 to surface 20B, thus sealing chamber 30 which contains the metal peg ring segments assembly. Bracket 110 can support plate 10 as seen in FIG. 2.

FIGS. 1 and 2 show inserts 23A and 23B which are located at the outer wall 21 of housing 20. The function of these rubber inserts 23A and 23B as an "anti-jamming" device which are located at those particular points on the interior surface of the inner chamber due to the fact that the rotation of the segments through the elliptical chamber incur the greatest stress at inserts 23A and 23B. Therefore, with the resilient inserts being placed at those particular points, the wall of the elliptical chamber is able to "give" a slight bit, therefore allowing the segments to continue in their elliptical path during operation.

FIGS. 1 and 6–8 show a plurality of ports 31 through 34, which are in position at equal intervals on the body of housing 20. Ports 31 through 34 lead from pumping chamber 30 to the exterior of apparatus 10. Ports 31 through 34 function as inlets (31, 34) and outlet ports (32, 33) during the pumping operations.

In the operation of pump 10, an external power source (such as an electric motor) would be connected to shaft 55. Upon activation of the power source, shaft 55 would rotate within the opening 65 of cover plate 90 facilitated in its rotation by the bearing 92. Rotor plate 57 would rotate with the shaft 55 within recess 93 of cover plate 90. Within the sealed elliptical pumping chamber 30, metal pegs 51 through 54 would rotate and turn engaging the interior surfaces of segments 41 through 44 which would then rotate freely around metal pegs 51 through 54 but still be confined to the elliptical chamber of metal housing 30. The pumping ability of the apparatus 10 is due to the movement of the driven segments 41 through 44 through their path within chamber 30.

Sealing plate 70 is provided with four ports (FIG. 6) 31P through 34P which lead to the chamber 30, the ports serving as intake and outtake ports during the operation of the pump registering with the ports 31–34 of housing 20.

Figure 7:
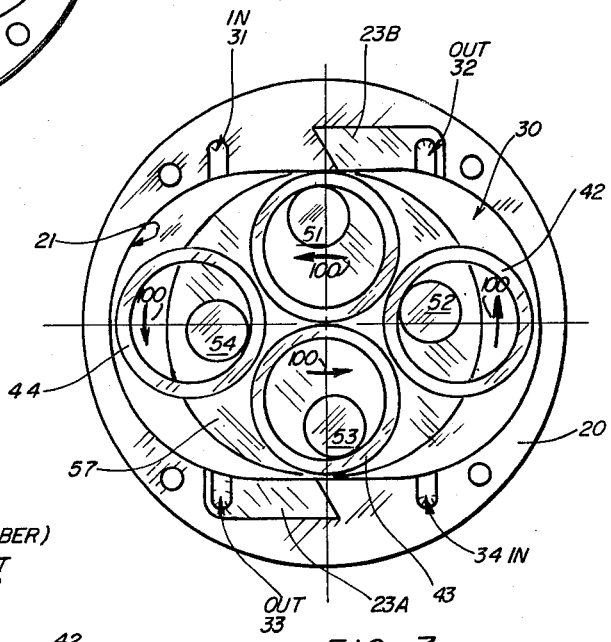
FIG. 7 is a sectional view of the preferred embodiment of the apparatus of the present invention illustrating the housing, ring segments, and ring drive portions thereof.
Figure 8:
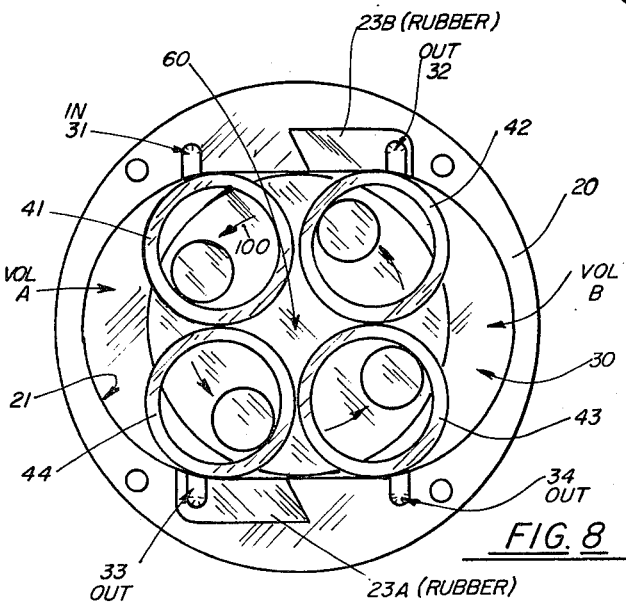
FIG. 8 is another sectional view of the preferred embodiment of the apparatus of the present invention illustrating the housing, pumping chamber, ring segments, and ring drive portions thereof shown in a different pumping position than the sectional view of FIG. 7.

As the segments 41 through 44 rotate in the path around the elliptical chamber 30, FIGS. 7 and 8 illustrate in sequence the pumping by the movement of the segments 41–44. In FIG. 7, the segments are rotating counterclockwise, driven by the external power source. It will be noted that the fluid between segments 41 and 42 is being discharged to port 32 and the fluid between segments 43 and 44 is being discharged from port 33.

The rotational path shown by the arrows 100 in FIGS. 7 and 8 as being counterclockwise forces fluid contained between the segments to discharge ports 32, 33 and creates a suction between segments which intakes fluid at ports 31, 34.

In FIG. 8, all four segments are adjacent ports 31–34. Note that each segment in this position touches an adjoining segment as well as the inner wall 21 of housing 20. At this instant, a complete intake and a complete discharge of fluid has occurred. A large void space is seen at each extreme end portion of chamber 30. These void spaces in FIG. 8 have been indicated in the drawing as Vol. A (for volume A) and Vol. B (for volume B). It is this void space which is now filled with fluid to be pumped that defines the volume of fluid which can be moved at any given time between two adjacent segments. One skilled in the art will appreciate that as the circular rotation of rotor plate 57 continues, segment 41 will proceed past intake 31 creating a vacuum which will allow fluid to flow into chamber 30 from intake port 31. In like fashion, intake 34 will introduce fluid into chamber 30 as segment 43 moves toward the position which segment 42 occupied in FIG. 7. Likewise, segments 42 and 44 will move away from discharge ports 32, 33. As this occurs, the enlarged fluid containing voids Vol. A and Vol. B will be emptied into discharge ports 32, 33 as the next segments 41, 43 respectively move toward discharge ports 33, 32. The elliptic construction of chamber 30 in combination with the abutting segments which are separate and movable with respect to one another as aforementioned produces the pumping function.

Anti-jamming elements 23A and 23B are used to prevent dual rotation of the pump and to provide pumping movement in only one pre-determined direction so that to ensure a proper sequence of inlets and outlets. During the operation there is a moment when two pegs and their respective segments are driven by a perpendicular force against the flat portion of wall 21 of elliptical chamber 30. It has been proven by experiments that a jamming of segments occurs unless a pliable, flexible member is provided in these critical points to allow the continuing circular movements of the segments within the chamber.

Figure 9:
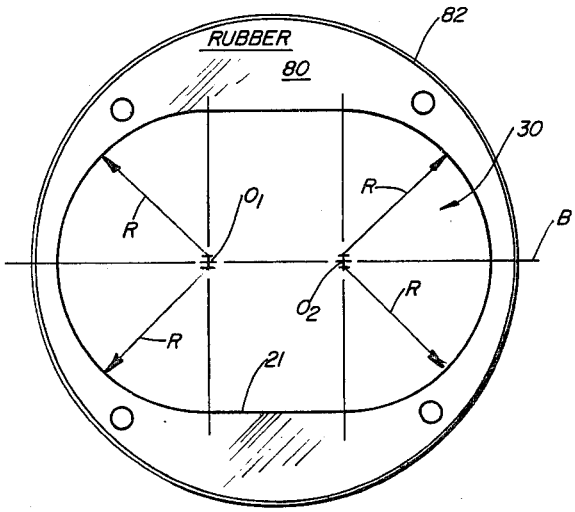
FIG. 9 is a sectional view of an embodiment of the apparatus of the present invention illustrating a rubber housing surrounding the housing chamber.

FIG. 9 illustrates an alternate embodiment of apparatus 10 wherein the chamber 30 has a thickened resilient or rubber body portion 80 which is encased in metal ring 82 for support. The resilient body 80 makes up the inner chamber wall 21 providing flexibility in the wall 21 as the ring-segments 41 through 44 travel in their elliptical concentric path through the chamber 30.

An alternative embodiment of segments 41 through 44 would provide segments constructed of a resilient rubber material and therefore, during the movement through elliptical chamber 30, due to their resiliency, are able to mold slightly in their path. This embodiment is especially adapted for pumping air and gases while little wear on segments 41–44 is expected. The preferred embodiment would illustrate these resilient rubber segments, in that their configuration for the most part would remain unchanged during their circulation through the chamber.

Figure 11:
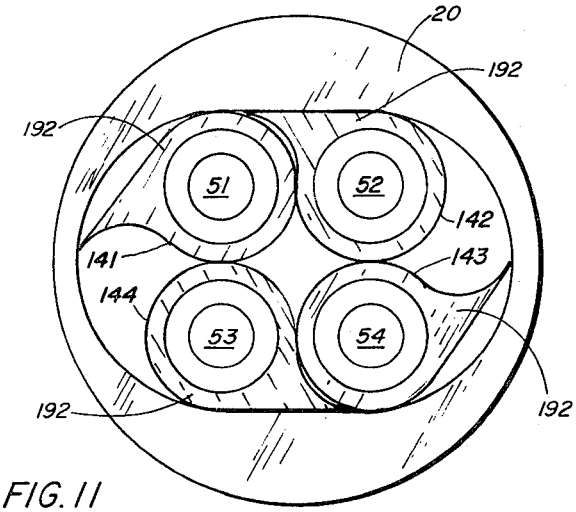
FIG. 11 is a sectional view of another second alternative embodiment of the apparatus of the present invention.

FIG. 11 illustrates an alternative embodiment of segment 141 through 144 embodiment where the segments 141 through 144 are adapted so that the spaces between the segments 141 through 144 are partially filled with a tapered tail portion 192. In this embodiment, segments 141–144 would slide rather than rotate in operation.

Figure 4C:
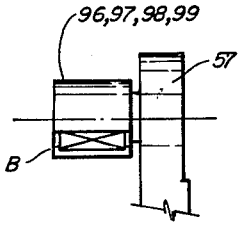
FIG. 4C is a partial view of an embodiment of the apparatus of the present invention illustrating one of the pegs adapted with ring bearings.
Figure 4A:
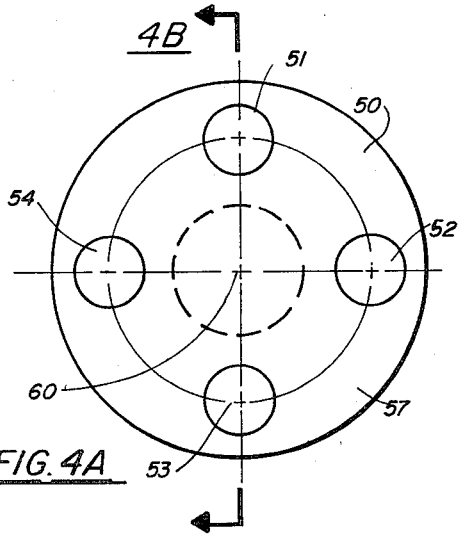
FIG. 4A is a front view of the ring drive portion of the preferred embodiment of the apparatus of the present invention.
Figure 4B:
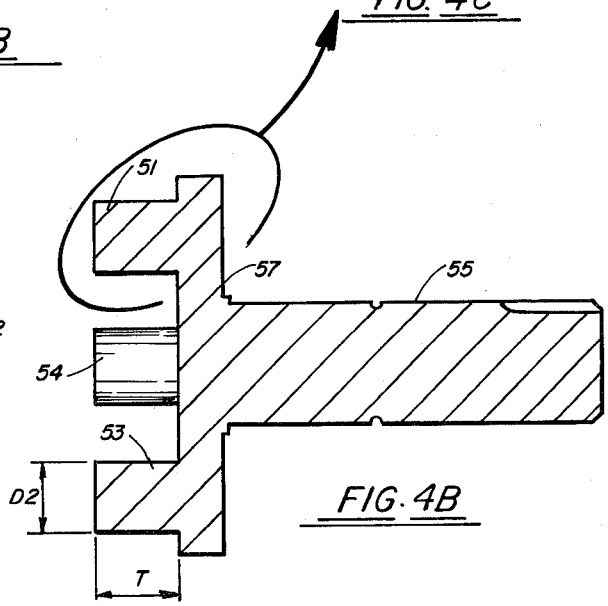
FIG. 4B is a sectional view taken along lines 4B—4B of FIG. 4A.

An additional embodiment of the peg portions of segment drive 50 is shown in FIG. 4C, wherein the pegs 96 through 99 are adapted with exterior bearings "B" which facilitate the rotation of ring segments 41 through 44 in their path and reduce wear on the peg/-segment contact surfaces.

Figure 10:
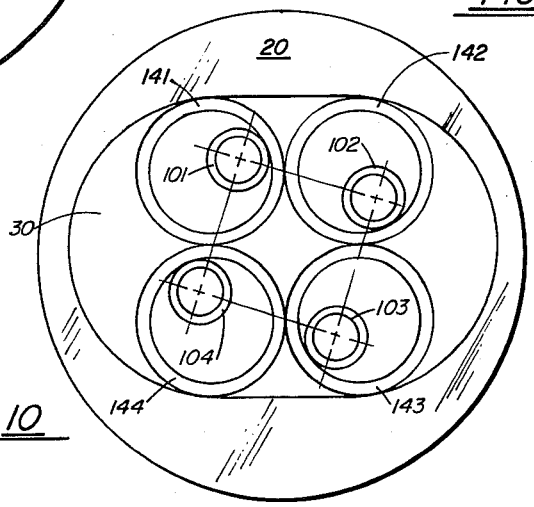
FIG. 10 is a sectional view of an alternative embodiment of the apparatus of the present invention.

A further alternate embodiment is illustrated in FIG. 10 wherein the ring segments 41 through 44 are adapted with reduced sized ring segments 101 through 104 which are located inside the opening of ring segments 41 through 44. Reduce size ring segments 101 through 104 would rotate around pegs 51 through 54 respectively, as illustrated in FIG. 10.

FIG. 2A illustrates the teaching of the layoutof chamber 30 wherein a central point "P" is located and four radii points are located along axis 60, extending equal distance from "P", designated as radii R1, R2, R3 and R4, as illustrated in FIG. 2A. These circles of the four radii curve out the four curved wall segments of chamber 30. Each radius would be equal to the overall diameter O.D. of segment 41–44 in the preferred embodiment. In the embodiment of FIG. 9, four equal sized radii R can be seen with each pair of radii having respective common points of origin O1 and O2 with the four equal sized radii R extending outward from points equidistant above and below line B as illustrated in FIG. 9. In the embodiment of FIG. 2A, the origins of each radius R1–R4 are spaced by a dimension A from the line B which intersects axis 60 and represents a plane through the center of housing 20 dividing it into equally sized upper and lower halves.

In FIG. 2A, the dimension C indicates the distance between points of origin R1, R4 and R2, R3. These points of origin respectively would be equidistant from axis 60, as best seen in FIG. 2A.

Figure 14:
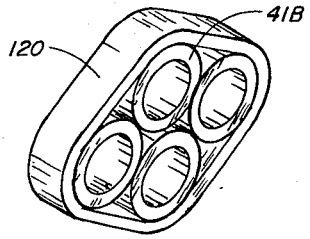
FIG. 14 is a perspective view thereof.
Figure 12:
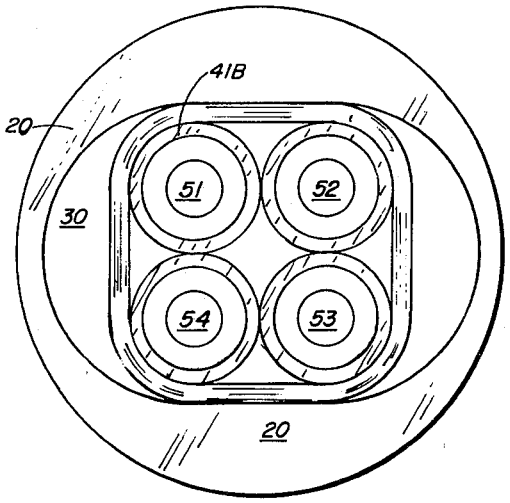
FIG. 12 is an alternative embodiment of the apparatus of the present invention illustrating a flexible housing as shown in FIG. 7 illustrating an alternative embodiment of the ring segments and endless belt portions thereof.
Figure 13:
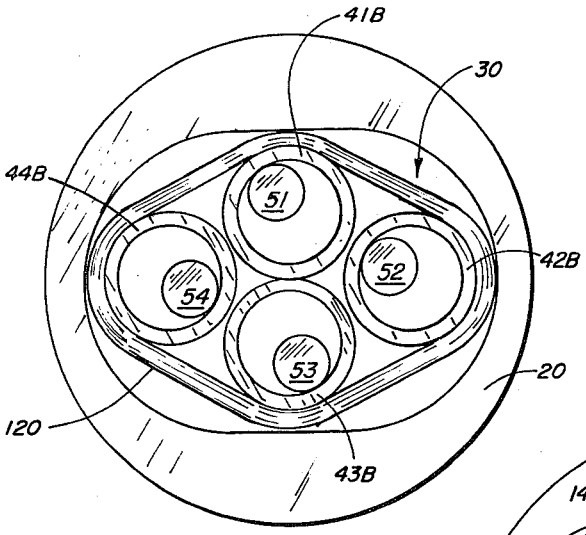
FIG. 13 is another view of the ring and endless belt alternative embodiment of the apparatus of the present invention as shown in FIG. 12.

The embodiments of FIGS. 12–14 illustrate an embodiment which utilizes a plurality of ring segments 41–44 as was described with the preferred embodiment. However, there is additionally provided between segments 41–44 and the inner wall 21 of housing 20 continuous endless belt 120 as best seen in FIGS. 12–14. Belt 120 could be for example of flexible construction such as neoprene or the like.

Figure 6:
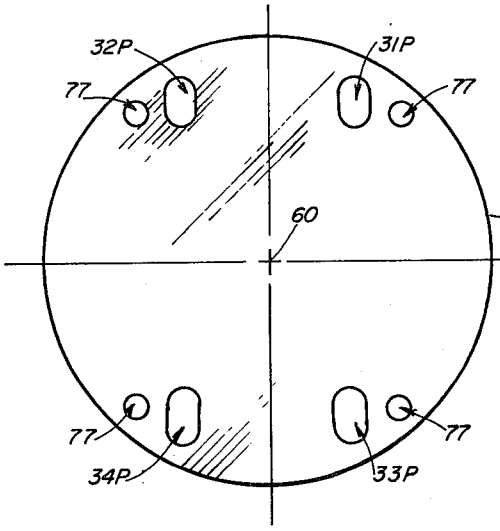
FIG. 6 is a frontview of the cover plate of FIG. 5.
Figure 5:
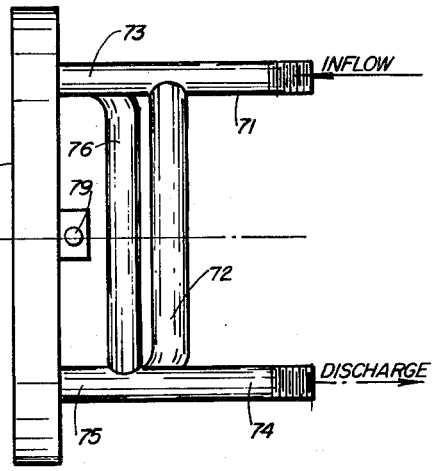
FIG. 5 is a side view of one cover plate portion of the preferred embodiment of the apparatus of the present invention illustrating the intake and discharge line portions thereof.

FIGS. 5 and 6 show more particularly the construction of cover plate 70. It should be understood that cover plate 70 would be useful with all the embodiments discussed. Cover plate 70 provides ports 31P–34P as above discussed which communicate respectively with influent and discharge lines 71, 74 respectively as best seen in FIGS. 2 and 5. Inflow 71 provides a pair of influent branch lines 72, 73 which communicate respectively with intake ports 31P, 34P.

In like fashion, discharge 74 provides a pair of discharge branch members 75, 76 which communicate respectively with discharge ports 32P, 33P.

Also provided on cover plate 70 is bleed port 70 which would provide a vent to the central 60 portion of chamber 30. Port 79 would allow a vent for fluid fluctuation created in the area at the center of the ring segments 41–44 as this area would be subject to contsantly changing volume during the pumping cycle. Port 79 could for example be connected by tubing or the like to inflow 71 if desired.

Assembly of valve 10 could be for example by means of threaded bolts 96 and nuts 98. Washers W could be used as required.

Assembly openings 27, 77, and 97 would be provided respectively in housing 20, cover plate 70 and cover plate 90.

It should be noted that in all embodiments of the apparatus the materials utilized may be metal, plastics, semi-rigid rubber based materials, and the like. The materials utilized in the construction of the apparatus are flexible depending on the uses which the pump apparatus would be adapted to. Of course, the pump apparatus could be constructed in various sizes depending on the volume of fluids and the like which are to be pumped.

Because many varying and different embodiments may be made within the scope of the inventive concept herein taught, and because many modifications may be made in the embodiments herein detailed in accordance with the descriptive requirement of the law, it is to be understood that the details herein are to be interpreted as illustrative and not in a limiting sense.

What is claimed as invention is:

1. A rotary pump apparatus with plural abutting pumping segments comprising:

a. a housing having an inner pumping chamber portion;

b. input means communicating with said chamber for allowing a fluid stream to be pumped to enter said chamber;

c. output means communicating with said chamber for discharging fluids from said chamber;

d. a plurality of separate abutting segments movably mounted within said chamber in a circulating rotary fashion, said segments during operation driving fluids from said input means through said chamber to said output means, each of said segments abutting at least two segments during pumping through said chamber;

e. powered driving means for circulating said plurality of segments in a rotary fashion within said chamber, said driving means comprising:

i. a rotary plate;

ii. a plurality of metal pegs fixedly attached to one surface of said plate;

iii. a shaft fixedly attached to a second surface of said plate, said shaft and plate each defining a common rotational axis;

iiii. a means for circulating the shaft.

2. The apparatus of claim 1, wherein said housing provides exterior coplanar wall portions defining a substantially thin equal thickness housing therebetween.

3. The apparatus of claim 2, wherein said housing is of a cylindrical wafer shape.

4. The apparatus of claim 1, wherein said chamber is a-circular, having at least one void space end portion.

5. The apparatus of claim 1, wherein said input means comprises a series of ports extending through the wall of said housing communicating with said housing chamber.

6. The apparatus of claim 1, wherein said segments are substantially of equal thickness as the thickness of said chamber.

7. The apparatus of claim 1, wherein the number of said pegs is equal to the number of said segments.

8. The apparatus of claim 1, wherein each segment loosely encircles each metal peg.

9. The apparatus in claim 1, wherein the segments provide each an inner diameter larger than the diameter of the metal pegs to allow for concentric rotation of the segments during the rotation of the rotor plate.

10. The apparatus in claim 1, wherein the circulation of the segments within the chamber cause a fluctuation in the space between segments resulting in the intake and output of fluids through the intake and output means respectively.

11. The apparatus of claim 1 further comprising means for sealing the chamber of said housing, and means for connecting to said intake means and to said output means delivering fluids respectively to and from said chamber during operation.

12. The apparatus of claim 1, further comprising anti jamming means for preventing rotation of said segments in one rotational direction.

13. The apparatus of claim 1, wherein said driving means further comprises at least in part a bearing sealing the rotor plate and the shaft at the connection with one of said housing.

14. A rotary pump apparatus with plural abutting pumping segments, comprising:

a. a substantially cylindrical wafer-shaped housing having a central portion with an inner elliptically shaped chamber;

b. a top and bottom sealing plates for sealing said chamber, at least one plate being adapted with a pair of input ports for allowing a passage of fluid into said chamber and further adapted with a pair of output ports for allowing a passage of fluid from said chamber;

c. four identical cylindrical segments for circulating within said chamber each of which communicates with the walls of the chamber while simultaneously communicating with at least two other segments at all times in the chamber for pumping said fluid into and out of said chamber;

d. powered drive assembly, comprising:

i. a rotor plate;

ii. four metal pegs fixedly attached to one surface of said plate for inserting loosely into the opening of said cylindrical segments and driving said segments to circulate around the inner elliptical wall of said chamber when the rotor plate is rotated;

iii. a shaft fixedly attached to a second surface of said plate, said shaft and plate each defining a common rotational axis;

iiii. a means for circulating said shaft;

e. a metal housing for encasing said shaft;

f. anti-jamming means on said housing for preventing dual rotation of said rotor plate and for providing pumping movement in one pre-determined direction, said anti-jamming means comprising at least in part a pair of pliable inserts mounted on the inner wall of said housing adjacent to said chamber.

15. The apparatus of claim 14, wherein the circular motion of the segments around and within the elliptical chamber create a fluctuation in the space between the segments resulting in the intake and output of fluid or gas through the intake and output ports.

16. The rotary pump apparatus of claim 14, wherein said top and bottom sealing plates are attached respectively to opposite face portions of said central portion of said housing during operation, with said sealing plates also forming cover plates over said chamber on opposite sides of said central portion of said housing.

17. The rotary pump apparatus of claim 14, wherein each of said identical cylindrical segments provides a central cylindrical opening defining an inner wall with each of said segments likewise having an exterior wall and being of constant thickness with said inner wall and said outer wall being concentric.

18. The rotary pump apparatus of claim 14, wherein each of said segments is a ring body having a curved tail portion attached thereto with each of said ring body portions being equally sized and providing equal sized respectively inner openings.

19. The rotary pump apparatus of claim 14, wherein said equal sized segments are equally sized cylindrical rings having equal sized inner openings and there is further provided belt means circumventing said plurality of rings and being disposed generally between said chamber inner wall and said plurality of rings during operation.

20. The rotary pump apparatus of claim 14, further comprising a plurality of four equal sized ring segments being smaller in diameter than said four equal sized segments and being mounted respectively within each of said four equal sized segments and respectively on said four metal pegs of said rotor plate.

21. The rotary pump apparatus of claim 14, wherein said metal housing encasing said shaft is a bearing mounted in one of said sealing plates.

22. The rotary pump apparatus of claim 14, wherein said housing provides an outer cylindrical metallic wall and an inner housing body of pliable material.

23. The rotary pump apparatus of claim 22, wherein said pliable material is neopreme.

24. The rotary pump apparatus of claim 14, wherein said inserts are neoprene.

25. The rotary pump apparatus of claim 14, wherein there is further provided an endless belt surrounding said four equal sized segments and being disposed generally between said chamber inner wall and said segments during operation with said belt defining between said inner wall and said belt at least one pumping chamber external to said belt and said segments.

26. A rotary pump apparatus with plural abutting pumping segments, comprising:

a. a cylindrical wafer-shaped housing providing an inner pumping chamber, said housing having coplanar face portions substantially perpendicular to the central axis of said cylindrical housing;

b. a pumping chamber disposed within said housing, said chamber being generally elliptical in shape and being symmetrically disposed within said housing about said axis;

c. a pair of circular cover plates attached during operation respectively to said pair of housing face portions, each of said plates during operation forming a seal with said housing and about said pumping chamber;

d. input means for supplying a source of fluid to be pumped to said chamber;

e. discharge means communicating with said chamber for discharging a fluid being pumped from said chamber;

f. a plurality of individual separate cylindrical segments disposed within said elliptical chamber, each of said segments communicating with at least two other segments, said segments being rotationally movable in an elliptical path about said axis during a pumping operation;

g. rotational power means being connectable during operation to said segments for moving said segments in an elliptical path within said elliptical chamber.

27. The rotary pump apparatus of claim 26, wherein said segments are a plurality of substantially equally sized cylindrical rings.

28. The rotary pump apparatus of claim 26, wherein said rotational drive means comprises:

a. a shaft connectable to a source of rotational energy;

b. a rotor plate affixed during operation to said shaft;

c. a plurality of drive members connected to said plate during operation and abutting at least sometime during operation said plurality of segments.

29. The rotary pump apparatus of claim 26, further comprising endless belt means surrounding said plurality of segments for urging at least in parts fluids from said input means to said discharge means.

30. The rotary pump apparatus of claim 26, wherein said input means is at least one port supplying a source of fluid to be pumped to said chamber.

31. The rotary pump apparatus of claim 26, wherein said discharge means is at least one port communicating with said chamber for discharging fluids from said chamber.

* * * * *